US006029404A

United States Patent [19]

Lewis

[11] Patent Number: 6,029,404

[45] Date of Patent: Feb. 29, 2000

[54] INFLATABLE STRUCTURE WITH SEALABLE COMPARTMENT THEREIN

[76] Inventor: Edward F. Lewis, 3713 Gallo Dr., Chalmette, La. 70043

[21] Appl. No.: 09/109,520

[22] Filed: Jul. 2, 1998

[51] Int. Cl.[7] ..... E04B 9/08

[52] U.S. Cl. ..... 52/2.18; 52/2.11; 52/2.17

[58] Field of Search ..... 52/2.11, 2.17, 52/2.18

[56] References Cited

U.S. PATENT DOCUMENTS

| | | | |
|---|---|---|---|
| 2,129,261 | 9/1938 | Chase et al. | 52/2.11 X |
| 3,120,682 | 2/1964 | Reffell . | |
| 3,256,895 | 6/1966 | Duquette . | |
| 3,393,479 | 7/1968 | Slotnick | 52/2.17 |
| 3,857,209 | 12/1974 | Milliken | 52/2.17 |
| 4,004,380 | 1/1977 | Kwake . | |
| 4,271,642 | 6/1981 | Karr . | |
| 4,295,302 | 10/1981 | Liu | 52/2 |
| 4,296,960 | 10/1981 | Winchester | 52/2.17 X |
| 4,484,420 | 11/1984 | Stokes . | |
| 4,959,901 | 10/1990 | Parish . | |
| 4,991,363 | 2/1991 | Randmae . | |
| 5,007,212 | 4/1991 | Fritts et al. | 52/2.18 |
| 5,216,850 | 6/1993 | Kemper et al. . | |
| 5,247,768 | 9/1993 | Russo | 52/213 |
| 5,305,561 | 4/1994 | Goddard . | |
| 5,309,684 | 5/1994 | Davidovici . | |
| 5,471,797 | 12/1995 | Murphy | 52/2.17 |
| 5,566,512 | 10/1996 | Page . | |
| 5,570,544 | 11/1996 | Hale et al. | 52/218 |

FOREIGN PATENT DOCUMENTS

| | | | |
|---|---|---|---|
| 635028 | 1/1962 | Canada | 52/2.18 |
| 2043737 | 10/1980 | United Kingdom | 52/2.18 |

*Primary Examiner*—Carl D. Friedman
*Assistant Examiner*—Phi Dieu Tran A
*Attorney, Agent, or Firm*—Joseph N. Breaux

[57] ABSTRACT

An inflatable structure which includes a plurality of interconnected vertical and horizontal inflatable seamed baffled support members forming a frame structure for the inflatable structure with continuous canvas panels extending over all exterior surfaces of the inflatable structure including the structure's floor and further including a sealable door which is sealed by the use of magnets which not only seal the door but also act as a tripping device for an alarm which is electrically connected to the magnets on the door and further wherein the alarm system is tripped by variations of air pressure on the interior of the interior of the sealed inflatable structure. The inflatable frame support member are all inflated by a single air valve located in an interior of the structure.

5 Claims, 3 Drawing Sheets

INFLATABLE STRUCTURE WITH SEALABLE COMPARTMENT THEREIN

TECHNICAL FIELD

The present invention relates to devices and methods for inflatable buildings and more particularly to devices and methods for an inflatable structure with a sealable compartment therein which comprises a number of support members constructed as seamed baffled airways which are interconnected and air impermeable forming a inflatable frame structure with canvas panels bonded to and extending between the inflatable support members so as to form a weather tight structure when inflated. The inflatable structure also includes a heavy duty canvas floor which is sealably bonded to a perimeter of the inflatable members forming a heavy duty canvas floor and a air sealable door with magnetic closures and also including an audible alarm system with air pressure sensors and magnetic sensors electrically coupled to the magnetic secured doorway so that the alarm system sounds when an intruder either punctures a hole in the inflatable structure thereby causing a pressure decrease in the sealable compartment or by opening the magnetically sealed doorway.

BACKGROUND ART

There are numerous situations where a temporary structure is necessary to avoid the weather, or to store a vehicle, motorcycle, or other valuable items. A common problem associated with temporary storage buildings is security and ease of portability. Prior to the present invention there has never been a device which has addressed the problems of portability and security. There are numerous prior art devices which have attempted to overcome these problems. The prior art inventions are as follows:

Hale, et al, U.S. Pat. No. 5,570,544 which discloses an inflatable structure.

Paige, U.S. Pat. No. 5,566,512 which discloses an inflatable storage chamber.

Davidovici, U.S. Pat. No. 5,309,684 which discloses a multi purpose dry storage system.

Goddard, U.S. Pat. No. 5,305,561 which discloses an inflatable housing structure.

Kemper, U.S. Pat. No. 5,216,850 which discloses a portable garage apparatus.

Randmae, U.S. Pat. No. 4,991,363 which discloses a portable protective inclosure for a vehicle.

Parish, U.S. Pat. No. 4,959,901 which discloses a portable inflatable shelter in methods of erection thereof.

Stokes, U.S. Pat. No. 4,484,420 which discloses a flexible enclosure for protecting materials or things.

Liu, U.S. Pat. No. 4,295,202 which discloses an inflatable tent.

Karr, U.S. Pat. No. 4,271,642 which discloses a tent with inflatable tube erector.

Kwake, U.S. Pat. No. 4,004,380 which discloses a double walled inflatable structures.

Duquette, U.S. Pat. No. 3,256,895 which discloses a tension restrained air supported structure.

Ressell, U.S. Pat. No. 3,120,682 which discloses a collapsible building.

As can be seen from the prior art there has never been an inflatable structure with a sealed compartment therein as the present invention which provides for ease of portability and security. The present invention is inflated by a single air inlet valve which fills numerous seamed baffled support members which are interconnected and further wherein canvas panels extend between the members forming the structure while a heavy duty canvas floor is also interconnected to the support members. Additionally, the device includes a security system which is tripped by variations in air pressure within the sealed compartment or tripped by opening the magnetically secured air tight passage way.

GENERAL SUMMARY DISCUSSION OF INVENTION

It is thus an object of the invention to provide an Inflatable Structure with Sealable Compartment Therein which is easy portable by the user and easily inflated with air and erected.

It is a further object of the invention to provide an Inflatable Structure with Sealable Compartment Therein that includes a built in security system which is tripped by variations in air pressure in the sealed compartment therein.

It is a still further object of the invention to provide an Inflatable Structure with Sealable Compartment Therein that includes a built in security system which is tripped by opening a front passage way of the sealed compartment and separating magnets which secure the air tight front passage way.

It is a still further object of the invention to provide a Inflatable Structure with Sealable Compartment Therein that includes a number of interconnected inflatable support members which are filled by a single air valve affixed to one of the support members near the front interior of the unit. Canvas panels are bonded to the inflatable support members and extend between the support members to form a weather tight cover over the structure when the support members are inflated. The support members includes numerous rib members which extend vertically forming the wall support members and continue upwardly to form a roof frame structure while numerous horizontal interconnecting support members extend between the vertical rib members and are all inflated by a single air valve, the numerous inflatable vertical and horizontal support member thereby increasing the structural integrity of the inflated structure. The support members are further seamed and baffled to increase the structural integrity of the structure when inflated. Furthermore, a heavy duty rectangular shaped canvas floor is sealably attached to a perimeter of the inflatable support members. A sealable door is included on one end of the structure and is sealably connected using magnetic strips. A built in security system is provided which is mounted within an interior of the compartment and includes a tripping mechanism for tripping the security system by variations of the air pressure within the compartment and further being tripped by an intruder opening the sealed door by separating the magnetic door sealable magnets.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the following description that in use one who would require the use of a small secure and portable structure would simply take the inflatable structure with sealed compartment therein out of its carrying case and inflate the structure with an electric compressor. When inflated the air valve would be closed and user would then be ready to enjoy the benefit of having a weather tight structure to protect a car, motorcycle or other items from damaging elements such as hail, rain, snow, etc. To arm or disarm the alarm system, the user would enter the interior of the inflated structure and press his or her alarm code number into the key pad and press the enter key button. The user would then have a set amount of time to exit the interior of the inflatable structure and seal the sealable doorway. In the event that one or more of the magnetic closures on the sealable doorway are separated the alarm would be activated sounding its audible siren to warn the user. Additionally, if an intruder cuts or tears the structure thereby altering the air pressure on the interior of the structure the siren would also sound thereby activating the user to the intruder. When not in use the inflatable structure with sealable compartment would be folded up, placed in a carrying case and stored until needed again.

Figure 1:
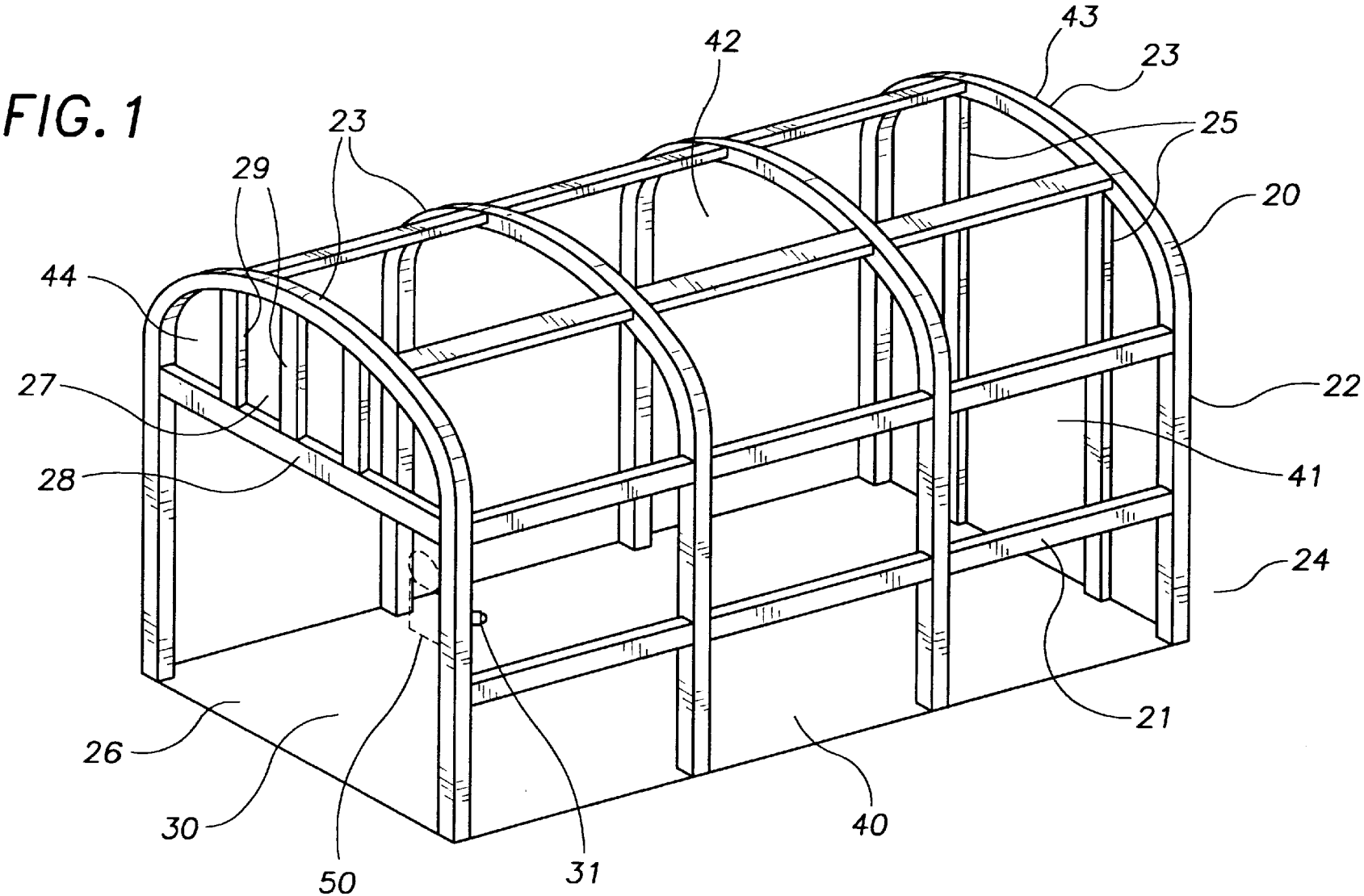
FIG. 1 is an isometric view of the Inflatable Structure with Sealable Compartment Therein illustrating the inflatable structure support members, and heavy duty canvas floor.

Referring to the figures in detail FIG. 1 illustrates numerous inflatable support members 20 which include a plurality of vertical rib members 22 and horizontal interconnecting support members 21, all of which are interconnected to form an inflatable frame structure for the inflatable structure. The inflatable support members 20 are preferably constructed of rubber coated or rubber impregnated canvas which is air impermeable. The support members 20 further have a cross section resembling a rounded rectangle with a central seam folded to an interior of the support member 20 providing additional structural support for the support member when it is inflated. Numerous horizontal interconnecting support members 21 extend between the vertical rib members 22 providing support for the structures walls while a roof section 23 is formed by an extension of the vertical rib members from a top of the walls. The rear of the structure 24 includes a plurality vertical inflatable members 25 interconnected with numerous horizontal support members. The front of the inflatable structure 26 includes a header member 27 which is comprised of a horizontal inflatable member 28 and a plurality of shorter vertical support members 29 interconnected between the horizontal member 28 and the roof member 23. An interior compartment 30 is formed by the structural rib components described above. All of the inflatable support members 20 preferably include an interior which is baffled which reduces the speed of the f low through the support members so that as forces are applied to the structure the support members will not collapse. One inflating valve 31 is installed near a front interior of one of the inflatable support members. All of the inflatable rib members and support members are interconnected so that the single valve is utilized for erecting the entire structure.

Floor member 40 is rectangular in shape and preferably constructed of heavy duty canvas and preferably includes a water proof coating. The floor member 40 is also sealingly connected to all of the vertical rib members 22 which extend to the floor member 40. An alarm system 50 is also installed in the interior 30 of the inflatable structure. The alarm system also includes wiring which extends from the alarm system 50 to magnetic sensors 51 and interior air pressure sensors 52.

Figure 2:
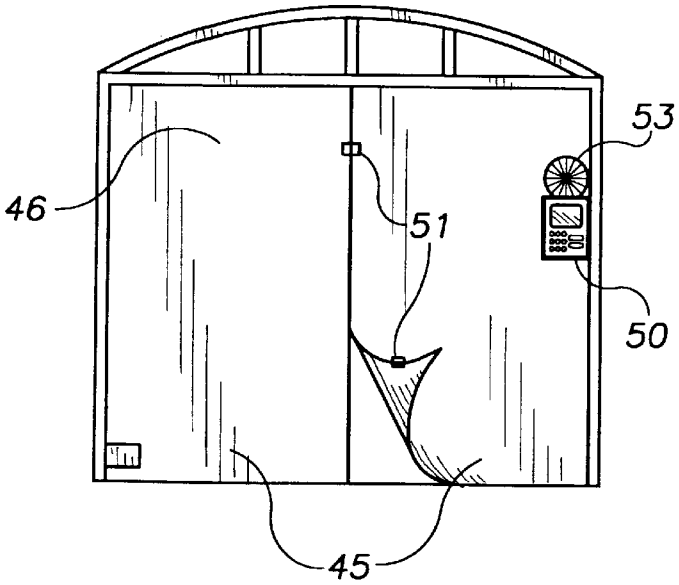
FIG. 2 is a front view of the device illustrating the front door on the inflatable structure.

Referring to FIG. 2 the front of the inflatable structure includes a sealable door 45 which comprises two flaps sealingly connected to vertical members on either side of the door. Additionally the doors are constructed of heavy duty canvas and may also include a water proof coating to prevent the intrusion of rain and other moisture. The doors 45 are sealingly attached to each other by the use of magnets 51 providing a air tight seal. The magnets 51 function not only to seal the door but also to provide a alarm tripping sensor for the alarm system 50. The magnets are electrically wired to the alarm system 50.

The wall panels 41 are preferably canvas with a rubberized coating and which extend between the openings formed by the vertical and horizontal inflatable support members. The canvas wall panels extend over the entire structure forming the structure's walls, roof 42, end panel 43, and front header panel 44. It is preferable that all horizontal and vertical inflatable support members are securely connected to the wall, roof, end, and front header panel. This continuous connection of all panels with support members provides the sealable compartment interior 30, which seal is finalized by the front door seal accomplished by the magnets.

Figure 3:
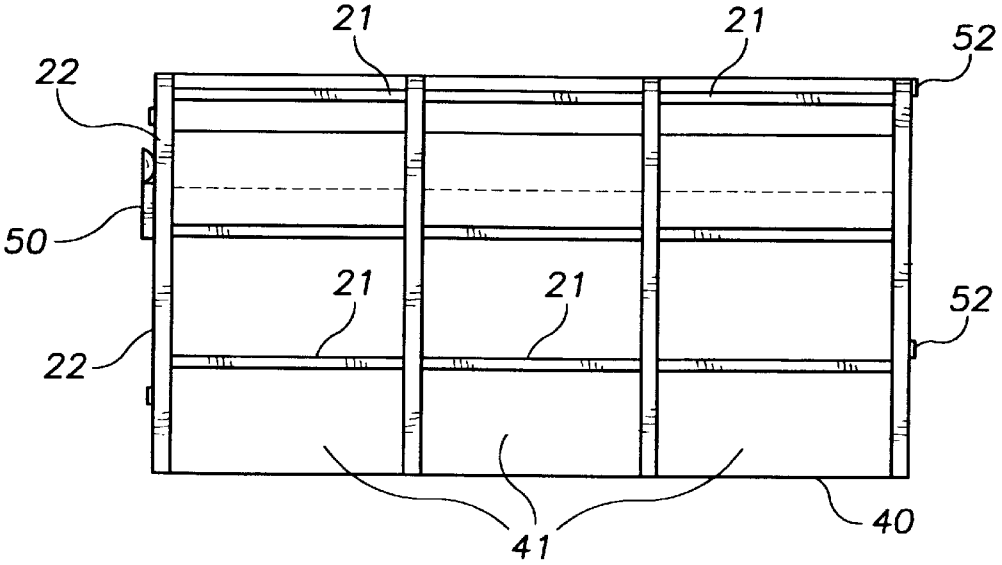
FIG. 3 is a side view of the inflatable structure illustrating the position of the inflatable vertical support ribs and interconnecting horizontal support members.
Figure 4:
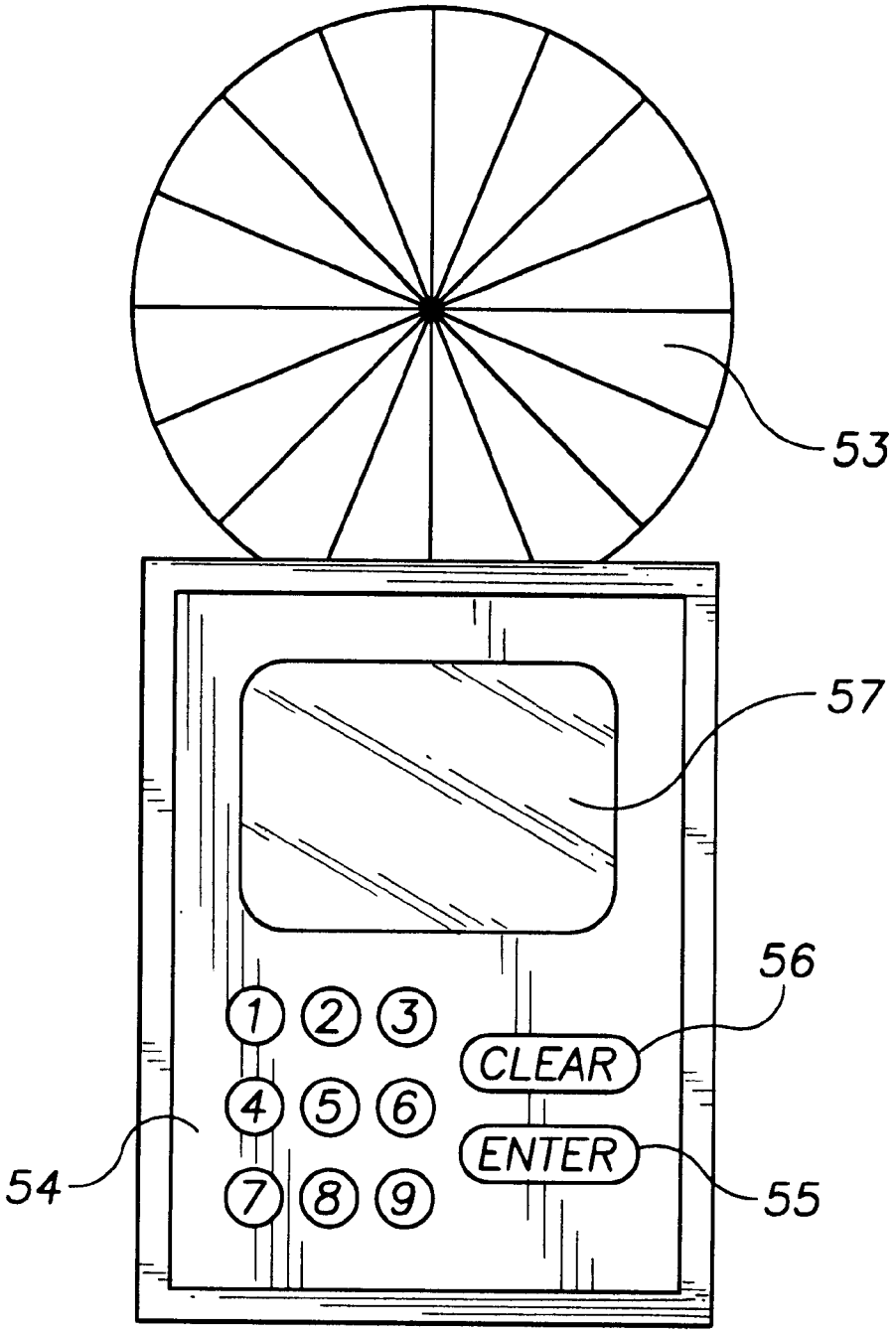
FIG. 4 is an illustration of the security alarm system which is installed/within an interior of the inflatable structure.

The alarm system 50 is preferably mounted on an interior of the compartment so that intruders or thieves do not tamper with the electronic alarm system while it is set. Additionally, the delayed alarm set sequence allows a user to set the alarm while in the interior of the inflatable compartment and then exit the inflatable compartment while sealing the door before the alarm automatically arms itself. The means for tripping the alarm include the magnetic door sealing magnets and the interior air pressure sensors. The alarm further includes an audible siren 53, numerous input buttons 54, a data entry button 55, a clear button 56 and an LCD display 57 indicating the status of the alarm system. The alarm system 50 may also be mounted on a exterior of the inflatable structure as illustrated in FIG. 3.

It is noted that the embodiment of the Inflatable Structure with Sealable Compartment Therein described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An Inflatable Structure with Sealable Compartment Therein comprising:

a) a plurality of inflatable interior baffled interconnected support members further comprising a plurality of vertical support member ribs forming wall support members for the inflatable structure wherein the vertical support member ribs extend to form roof support members, further comprising vertical rear wall support members and front door header support members while a plurality of interconnected horizontal inflatable support members extend between the vertical support members ribs and the rear wall support members, the front door header members and the roof support members, further wherein all the vertical and horizontal support members are constructed of air tight materials and are inflated at a single location within an interior space formed by the interconnected support members, b) a rectangular floor member securely connected to a bottom end of vertical support members, c) wall panel members connected to an outer surface of the vertical support member ribs and the interconnected horizontal support members forming exterior walls for the inflatable structure, a rear wall panel connected to an outer surface of the rear wall support members forming a rear exterior wall for the inflatable structure, a front door header panel connected to an outer surface front door header members forming an exterior front header wall for the inflatable structure, roof panels connected to an outer surface of the extended vertical support rib members forming a roof for the inflatable structure, further wherein all the exterior walls and roof panels are sealingly interconnected with each other and the floor member, d) a front door comprising two door panel flaps which are sealingly connected to outer vertical support members on a door opening of the inflatable structure, the door panel flaps are further sealingly secured in a closed position by a multiplicity of magnetic closures positioned around a perimeter of each door panel flap, the sealing door closures and the interconnected exterior wall and roof panels form an air tight interior of the inflatable structure, and e) an alarm system which includes a self contain alarm with input buttons for entering alarm codes for arming and disarming the alarm, an audible alarm indicator which is activated when the alarm is tripped and a LCD readout for visually determining the status of the alarm system, further wherein pressure sensitive switches are located in an interior of the inflatable structure which send an electrical signal to the alarm while the alarm is tripped when pressure inside the interior of the inflatable structure changes thereby alerting a user.

2. The Inflatable Structure with Sealable Compartment Therein of claim 1, wherein the wall and roof panels further comprise: wall and roof panels which are coated with a water proof coating thereby preventing water intrusion into the interior of the inflatable structure.

3. The Inflatable Structure with Sealable Compartment Therein of claim 1, wherein the inflatable interior baffled interconnected support members further comprise an air impermeable coating.

4. The Inflatable Structure with Sealable Compartment Therein of claim 1 wherein: the inflatable interior baffled interconnected support members further comprise members which are constructed of air and water impermeable material.

5. The Inflatable Structure with Sealable Compartment Therein of claim 1 wherein the alarm system further comprises a magnetically activated tripping device attached to the magnetic closures on the front door of the inflatable structure so that when some one enters the front door and separates the magnetic closures the alarm is tripped thereby alerting the user of a possible intruder.

* * * * *